US006626379B1

(12) United States Patent
Ritsche et al.

(10) Patent No.: US 6,626,379 B1
(45) Date of Patent: Sep. 30, 2003

(54) APPLICATION METHOD FOR AT LEAST TWO DIFFERENT MEDIA AND DISPENSER THEREFOR

(75) Inventors: Stefan Ritsche, Radolfzell (DE); Karl-Heinz Fuchs, Radolfzell (DE)

(73) Assignee: Ing. Erich Pfeiffer GmbH (DE)

( * ) Notice: Subject to any disclaimer, the term of this patent is extended or adjusted under 35 U.S.C. 154(b) by 0 days.

(21) Appl. No.: 09/554,031

(22) PCT Filed: Oct. 22, 1998

(86) PCT No.: PCT/EP98/06712

§ 371 (c)(1),
(2), (4) Date: May 8, 2000

(87) PCT Pub. No.: WO99/24171

PCT Pub. Date: May 20, 1999

(30) Foreign Application Priority Data

| | | |
|---|---|---|
| Nov. 8, 1997 | (DE) | 197 49 514 |
| Nov. 8, 1997 | (DE) | 197 49 513 |
| Aug. 17, 1998 | (DE) | 198 37 127 |

(51) Int. Cl.[7] ..... B05B 7/13; A62C 11/00

(52) U.S. Cl. ..... 239/337; 239/303; 239/304; 239/309; 239/329

(58) Field of Search ..... 239/337, 303, 239/304, 309, 329; 222/145.5, 82, 162, 320; 604/518, 520, 87, 89

(56) References Cited

U.S. PATENT DOCUMENTS

| | | | | |
|---|---|---|---|---|
| 3,191,808 A | | 6/1965 | Spalazzi et al. | |
| 3,595,439 A | | 7/1971 | Newby et al. | |
| 3,756,390 A | | 9/1973 | Abbey et al. | |
| 3,842,836 A | | 10/1974 | Ogle | |
| 3,857,392 A | | 12/1974 | Ogle | |
| 3,884,229 A | | 5/1975 | Raines et al. | |
| 3,995,772 A | | 12/1976 | Liautaud | |
| 4,648,532 A | | 3/1987 | Green | |
| 4,983,164 A | * | 1/1991 | Hook et al. | 604/87 |
| 5,171,219 A | * | 12/1992 | Fujioka et al. | |
| 5,286,257 A | * | 2/1994 | Fischer | 604/87 X |
| 5,307,953 A | | 5/1994 | Regan | |
| 5,429,603 A | * | 7/1995 | Morris | 604/87 X |
| 5,509,578 A | | 4/1996 | Livingstone | |
| 5,569,191 A | * | 10/1996 | Meyer | 604/87 X |
| 5,637,087 A | * | 6/1997 | O'Neil et al. | 604/87 X |
| 5,813,570 A | | 9/1998 | Fuchs et al. | |

FOREIGN PATENT DOCUMENTS

| | | |
|---|---|---|
| DE | 1 147 355 | 10/1963 |
| DE | 1 198 298 | 4/1966 |
| DE | 2 127 123 | 3/1972 |
| DE | 26 12 774 | 10/1976 |
| DE | 28 18 560 | 11/1978 |
| DE | 36 20 456 | 12/1987 |
| DE | 37 15 301 | 11/1988 |
| DE | 37 34 306 | 4/1989 |
| DE | 40 05 528 | 8/1991 |
| DE | 40 08 068 | 9/1991 |

(List continued on next page.)

*Primary Examiner*—Robin O. Evans
(74) *Attorney, Agent, or Firm*—Akerman Senterfitt

(57) ABSTRACT

In order to enable application of a dry i.e. powdery or granulated active substance, said substance is kept apart from a liquid supply in a dispenser. The powder is discharged with the help of said liquid during application. The liquid serves as a carrier for the active substance and is mixed with the liquid to varying degrees prior to discharge. The dispenser (11) has a liquid chamber (21) in an ampoule (19) which is provided with a closure stopper (26) which can be pierced. The liquid flow which is released upon actuation penetrates into a medium storage chamber (43), is mixed with the medium (51) therein and exits via an opened discharge outlet (44) in the form of a spray mist, jet or drop.

23 Claims, 5 Drawing Sheets

FOREIGN PATENT DOCUMENTS

| | | |
|---|---|---|
| DE | 40 23 541 | 1/1992 |
| DE | 92 16 359 | 12/1992 |
| DE | 689 17 531 | 3/1995 |
| DE | 295 07 218 | 8/1995 |
| DE | 44 12 041 | 10/1995 |
| DE | 692 02 356 | 10/1995 |
| DE | 44 25 218 | 1/1996 |
| DE | 295 12 760 | 1/1996 |
| DE | 44 41 263 | 5/1996 |
| DE | 195 02 725 | 8/1996 |
| DE | 295 16 077 | 3/1997 |
| DE | 693 04 968 | 3/1997 |
| DE | 195 41 594 | 5/1997 |
| DE | 197 00 437 | 7/1997 |
| DE | 196 06 703 | 8/1997 |
| DE | 197 12 256 | 11/1997 |
| DE | 196 27 228 | 1/1998 |
| EP | 0 245 788 | 11/1987 |
| EP | 0 614 702 | 9/1994 |
| EP | 0 679 443 | 11/1995 |
| GB | 1 453 591 | 10/1976 |
| GB | 2 148 401 | 5/1985 |
| GB | 2 251 898 | 7/1992 |
| WO | WO 95/27568 | 10/1995 |
| WO | WO 96/24439 | 8/1996 |

* cited by examiner

APPLICATION METHOD FOR AT LEAST TWO DIFFERENT MEDIA AND DISPENSER THEREFOR

FIELD OF APPLICATION AND PRIOR ART

The invention relates to the application or discharge of media, particularly pharmaceutical products in atomized, jet or drop form and a dispenser for the same.

WO 96/24439 discloses a disposable dispenser, in which a glass ampoule sealed by a rubber plug and containing a liquid medium is inserted in a sleeve connected to a dispenser by means of a preset breaking connection. The dispenser has a projecting nose adapter with an atomizing nozzle at the end. A central shaft or member in the interior of said adapter carries in the centre a needle which, on actuation by a manual pressing of the sleeve into the adapter, perforates the rubber plug. The shaft then presses the rubber plug as a plunger into the ampoule and consequently produces the application pressure.

This disposable atomizer is very reliable and is eminently suitable for the application of liquid medicaments, particularly those which have to be rapidly absorbed by the body, e.g. by the nasal mucosa, whilst also avoiding incompatibilities for the digestive tract which can arise in the case of oral ingestion. However, there are medicaments, which are not stable for a long period in liquid form.

Although there are numerous proposals for powder application and dosing, this is problematical and only possible by whirling up in large air quantities. This eliminates many fields of application, because a planned application is scarcely possible in this way.

U.S. Pat. No. 3,756,390 relates to a hypodermic syringe, which has two chambers for liquid and powder separated from one another by a piercing foil. To the powder chamber is connected a connecting piece in which a needle can be inserted after removing a protective cap. After piercing the separating foil the two media are mixed together. The protective cap is then removed, the needle inserted and injection carried out following air ejection. A similar procedure occurs in U.S. Pat. No. 3,595,439 A for a mixing cartridge for dental two-component material.

GB 1 453 591 describes an ampoule, which has a perforatable sealing plug for a liquid chamber and an intermediate plug for a powder chamber. On needle perforation, e.g. connected to a drop, the intermediate plug is ejected, so that the two media can mix with one another. The mixture can then pass through an extra channel into the drop chamber.

JP 8-280907 A discloses an adapter, which has a liquid chamber sealed by an aluminum foil and which can be mounted on a container with a freeze-dried pharmaceutical. On the other side of the adapter sealed with a screw cap can be engaged a pump atomizer, which with its suction tube perforates the aluminum foil and thus interconnects the liquid chamber and powder container. This dispenser which has to be assembled from three separate parts prior to use is not very helpful for uncomplicated use purposes.

PROBLEM AND SOLUTION

The problem of the invention is to provide a method and a dispenser for the application of two different media with which solid media can also be applied reliably, as well as in dosed, planned manner.

The invention provides a method in which a liquid is used as the carrier medium for the particulate solid medium and the separately stored media are only mixed together prior to their application. The term particulate solid medium is understood to mean that it is not in the form of a gas, liquid, paste or massive form, but instead normally dry with a certain flowability or free-flow capability and is in particular pulverulent or granular. Thus, it is possible to store the two media separately from one another and the active substance can be present in dry form usually in the particulate medium. It can e.g. be a pharmaceutical product in the form of a freeze-dried powder. Only just prior to application is it mixed with a liquid serving as the carrier medium. Either a suspension (dispersion) or also a solution can be obtained, which are then jointly applied, preferably as a spray mist, but also in drop or jet form.

Apart from the advantage that the product can be kept better in the dry powder form, the advantage also arises that the liquid can be so chosen that the absorption by the mucosa is particularly aided. There is no need for preservatives.

The particulate solid medium should preferably be pulverulent, but at least flowable or free-flowing and readily mixable with the liquid, so that in the relatively short available an intimate mixing or dissolving in the liquid is possible. However, it is also possible for the particles to be present in the form of so-called microcapsules, i.e. comprising the contents covered by a skin.

The direct and very immediate application following mixing is possible if the liquid is introduced into the solid medium under an application pressure and the resulting mixture is discharged under said application pressure. However, it is also possible to carry out mixing in a mixing phase directly upstream of the discharge or application. This e.g. makes it possible to ensure that firstly all the liquid is introduced into the chamber containing the solid medium prior to the start of application. In the case of particularly solution-active mixtures this can ensure a dissolving, or at least a good suspension of the solid medium in the liquid. The liquid acts as a carrier for the solid, but can itself have or contribute to pharmaceutical actions.

Advantageously between the mixing phase and the application phase there is a pressure point which has to be manually overcome for the actuating force, so that automatically there is a certain intermediate stop. The solid medium will not usually completely fill the chamber in which it is stored, which will contain an in part relatively large volume fraction of gas, e.g. air or also an inert gas aiding product stabilization. On mixing said gas can be compressed on introducing the liquid, so that finally on application, i.e. the opening of the solid reservoir or a mixing chamber there is already a certain initial pressure, which e.g. ensures a good atomization from the outset.

In addition, a dispenser is proposed, which has a liquid chamber, pressurizing means for producing an application pressure and for delivering liquid into a medium reservoir, separate from the liquid chamber, for a pulverulent or free-flowing solid medium and a discharge orifice for the mixture. The pressurizing means can be a thrust piston pump, whose cylinder can be the liquid chamber.

Prior to the actuation of the dispenser it is possible to keep the liquid chamber and the medium reservoir tightly sealed with respect to one another and the outside and only to connect the same with one another and to the discharge orifice through actuation. This can take place by perforating membrane-like pistons or container walls, by lip valves or the like.

The building up of pressure points, which permit the build-up of certain minimum actuating forces can take place both prior to the start of actuation and also between the mixing and application phase, e.g. by snap connections, but preferably by preset breaking points, i.e. material bridges which can be destroyed by actuating forces.

In the case of dispensers, which have a separate container for each application charge discharged all at once or in a few successive actuations, the opening of a medium chamber usually takes place by a thin, hollow needle, e.g. a steel needle, which is sharpened by a bevel and usually has a very small diameter below 1 mm. It is received in a shaft, which usually also presses the perforatable piston into the cylinder. In order to receive this thin, sensitive needle, it has hitherto been provided with a metal adapter, which was externally fitted to the needle as a relatively thick, solid, metal ring. It permitted an engagement of an assembly tool and was pressed into the shaft by means of an annular locking tooth system (cf. WO 96/24439). This arrangement has proved satisfactory and was considered unavoidable due to the reliable assembly without damaging the sensitive tip. However, it requires the metal adapter as a separate part, which increases costs and also the metal fraction in the dispenser which can otherwise be disposed of virtually in type-pure manner.

It has now been found that it is possible to fit the very thin and sensitive needle in damage-free manner with the necessary sealing action without said adapter. For this purpose it is introduced between the entire central area between the ribs of a larger bore in the shaft embracing both ends of the needle and at the end is pressed with press fit into a bore, which is somewhat longer than the needle diameter. It is supported on a shoulder within said bore and can consequently freely communicate to the discharge orifice. On insertion the needle is held at its end carrying the tip by a collet, which has a central pin engaging in the needle and consequently preventing a crushing and damage to the sensitive tip. This is important, because damage-free tips are necessary for the perforation of the closing plug in the same way as in a hypodermic needle, so as to avoid the needle detaching particles from the container or piston wall on penetrating the same and which would lead to a clogging of the discharge orifice or could even enter the respiratory tracts of the patient.

These and further features can be gathered from the claims, description and drawings and the individual features, both singly or in the form of sub-combinations, can be implemented in an embodiment of the invention and in other fields and can represent advantageous, independently protectable constructions for which protection is hereby claimed. The subdivision of the application into individual sections and the subtitles in no way restrict the general validity of the statements made thereunder.

BRIEF DESCRIPTION OF THE DRAWINGS

An embodiment of the invention is described in greater detail hereinafter relative to the drawings, wherein show.

DESCRIPTION OF THE PREFERRED EMBODIMENTS

Figure 1:
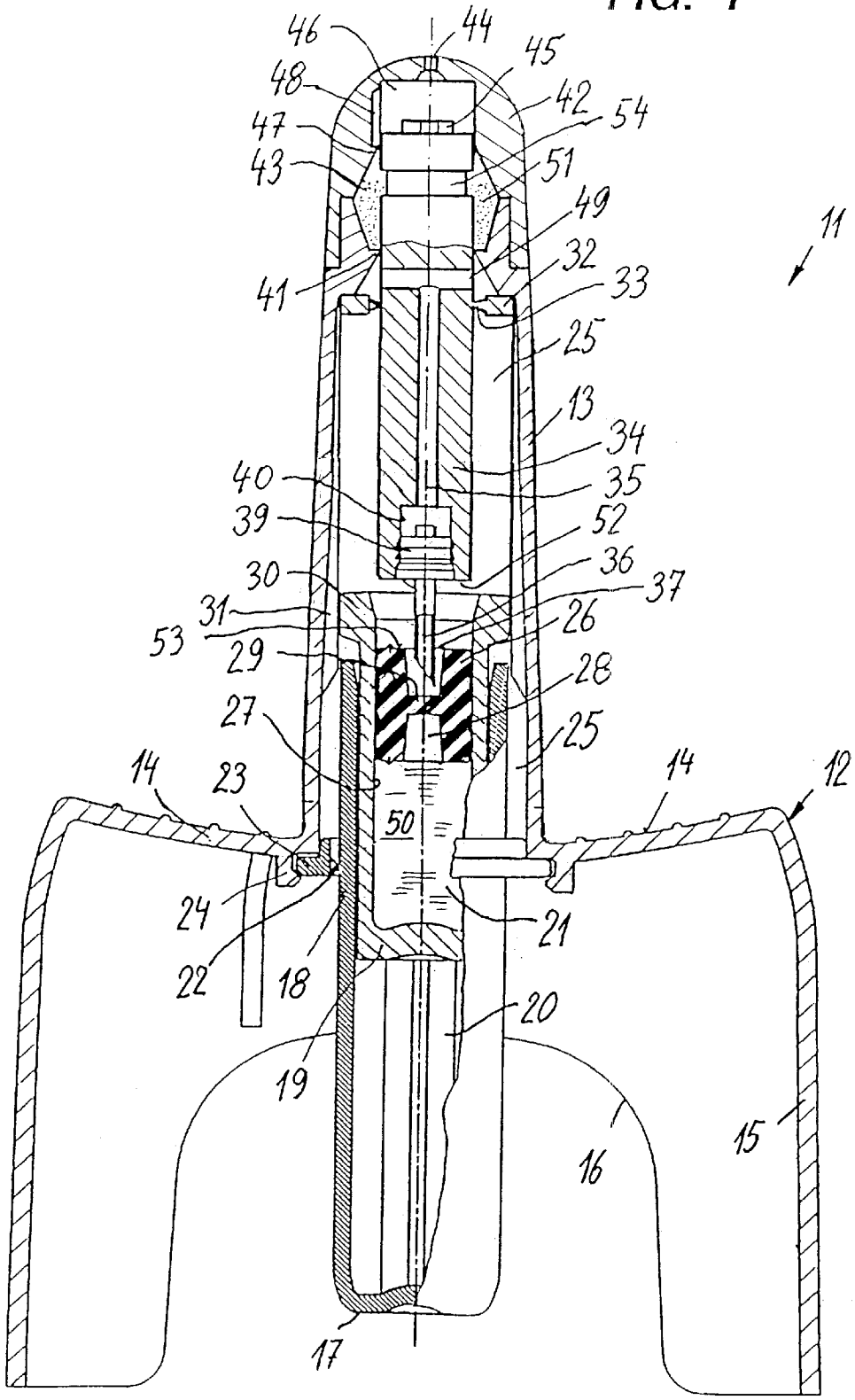
FIGS. 1 & 2 Longitudinal sections through a dispenser in two operating positions.
Figure 2:
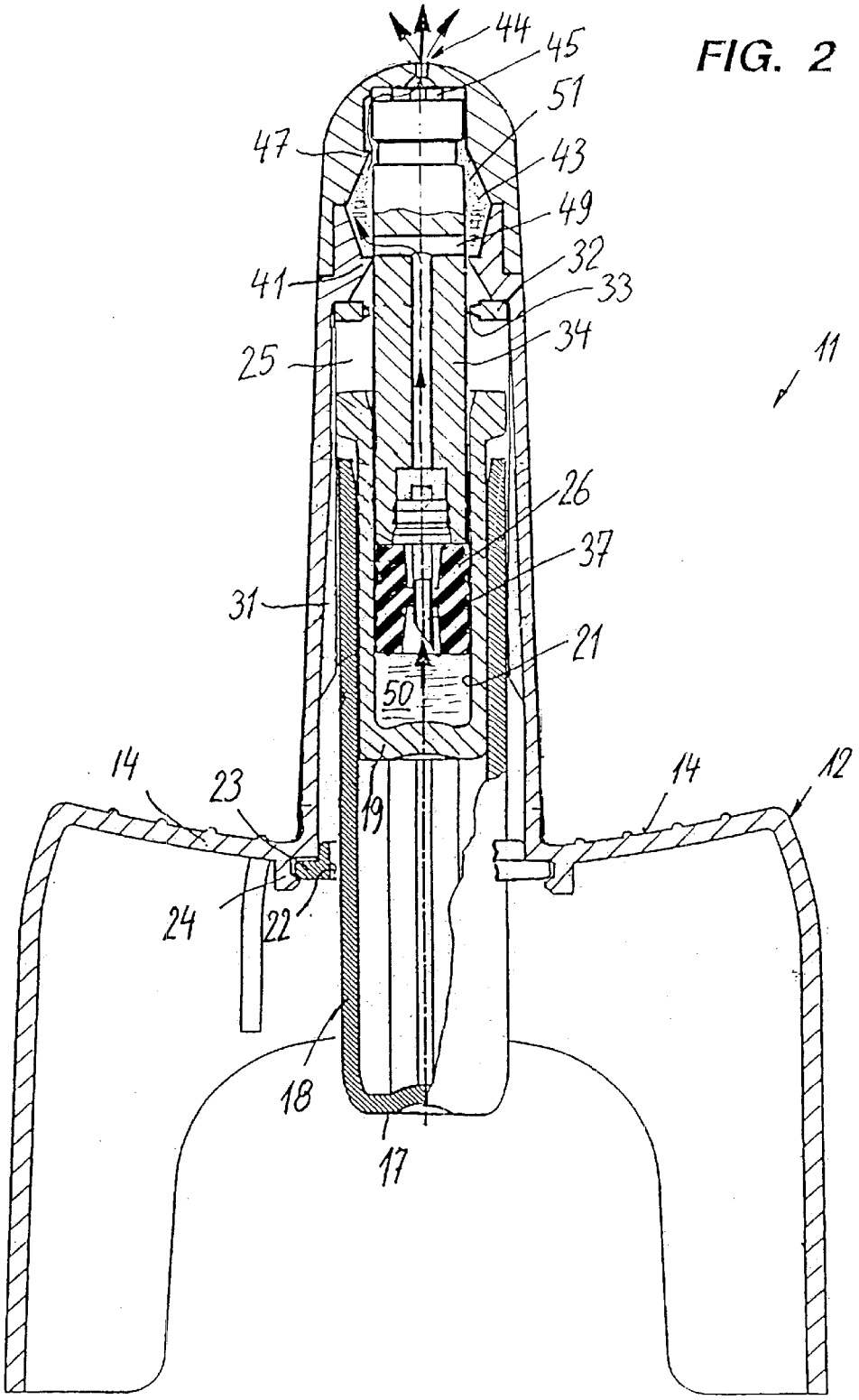

The dispenser 11 shown in FIGS. 1 and 2 is a disposable atomizer applying or discharging its complete charge in a single stroke. It has a casing 12 with an elongated adapter section 13. It projects centrally out of a casing actuating shoulder 14, which is oval in plan view and projects to two sides in epaulette-like manner. A casing jacket 15 directed in opposition to the adapter is connected to the shoulder 14 and has on its flatter sides in each case an actuating cutout 16.

Through the actuating cutout 16 the actuating face 17 of a sleeve 18 is accessible with a finger, which receives a glass ampoule 19, supported in the sleeve by webs 20 and which contains a liquid chamber 21. The sleeve 18 and ampoule 19 are in the form of elongated, deep, circular cylindrical containers.

Onto the plastic sleeve is shaped a ring 23 by means of thin, preset breaking point-forming, web-like material bridges 22 and which is received in a snap connection 24 on the underside of the shoulder, adjacent to the inner area 25 of the substantially hollow adapter 13.

The liquid chamber 1 in the ampoule 19 is sealed by a plug 26 made from a rubbery material and which sealingly engages on the circular cylindrical wall of the liquid chamber 21. It is relatively elongated and has central recesses 28, emanating from each of its end sides and which are separated by a central web 29, which forms a perforatable membrane. The sleeve 18 and ampoule 19 project centrally into the inner area of the adapter 13 and are guided there with the outer wall of the sleeve 18 and an upper flange 30 of the ampoule 19 on lateral webs 31 in the interior 25 of the adapter 13, namely over the length of an actuating path.

At the end of the actuating path a plunger 34 is received by means of a ring 32, which is connected thereto by means of preset breaking point-forming material bridges 33 and which extends in the interior of the adapter 13 centrally up to just before the ampoule 19 or its plug 26. In the interior of the plunger 34 there is a connecting channel 35, which is connected to the inner channel 36 of a hollow ram 37, which comprises a steel needle on which, directed towards the plug, is formed by bevelling a tip 38. The steel needle is received in a relatively solid metal adapter ring 39, which is externally provided with an annular, barb-like tooth system. By means of the latter it is pressed into an opening 40 in the plunger 34 connected to the connecting channel.

The connecting shaft 34 is guided and sealed above its predetermined breaking ring 32 by sealing and guiding lips 41 located in the interior 25 of the adapter 13. By a sealingly mounted end cap 42 forming the end of the adapter 13 an annular space is formed around the shaft 34 forming a medium reservoir 43 for a solid medium, e.g. a powder. Centrally in the end cap 42 is provided a discharge orifice 44, which is constructed as a spraying nozzle. It produces a conical spray jet with the aid of a vortex channel construction 45 at the front end of the shaft 34 and in operation it engages on the inside of the discharge nozzle 44. Spirally constructed channels ensure an angular momentum of the liquid or mixture rapidly flowing through them.

Between the nozzle interior and the end face of the shaft 34 is formed a discharge chamber 46, which is sealed with respect to the medium reservoir 43 by sealing lips 47 of the end cap 42. Adjacent to the sealing lips the discharge chamber contains in its cylindrical wall overflow channels 48.

The connecting channel 35 in the shaft 34 ends in lateral openings 49, formed by a transverse channel, on the shaft surface.

All parts of the dispenser with the exception of the glass ampoule 19 and the ram 37 formed by a steel needle with a metal adapter ring, are made from plastics. The liquid chamber 21 is filled with a liquid intended to mix on flowing out with a particulate solid medium in the medium reservoir 43, so as to dissolve or suspend respectively disperse the same and discharge it together with the liquid. The solid medium is a pharmaceutically active substance, usually in powder form. The liquid mainly preponderantly comprises water, which is present in a sterile form and optionally in a form physiologically adapted to the body fluid. However, also other liquids or liquid additives are possible, which can have characteristics furthering or initiating the activity of the solid medium. A two-component action can arise between the liquid and the solid medium.

The dispenser according to FIGS. 1 and 2 is in the position shown in FIG. 1 in the packing, storing and sale state. The liquid chamber 21 is filled with the liquid 50 and tightly sealed by the plug 26. The ram 37 is just above the web 29. The solid medium 51 is located in the medium reservoir 43, but there can simultaneously be present a normally even large quantity of air, which is due to the gaps between the particles, but which can also be additionally present so that the particles do not have to be filled in an excessively compacted form. The medium reservoir 43 is tightly sealed to the outside and inside by sealing lips 41 and 47 and the corresponding cylinder surfaces of the shaft 34.

For using the dispenser 11 the elongated adapter 13 is brought into the corresponding dispensing position, e.g. inserted in a nostril. The user grips the dispenser by placing two fingers on the shoulder 14, whilst pressing on the actuating face 17 with the thumb. He must initially exert a relatively high actuating pressure in order to destroy the preset breaking points formed by the material bridges 22 between the ring 23 and the sleeve 18 and which also form a tamper-evident closure.

The unit formed by the sleeve 18 and ampoule 19 is then moved upwards, i.e. into the interior 25 of the adapter 13. The needle-like ram 37 perforates the web 29 in the closing plug 26 and the lower face 52 of the shaft 34, which has a somewhat smaller diameter than the liquid chamber 21, strikes the face 53 of the plug 26. The latter consequently forms the piston of a thrust piston pump, whose cylinder is formed by the liquid chamber 21 or glass ampoule 19.

The upwardly directed axial pressure acting on the shaft 34, on actuation, also breaks the material bridges 33 connecting the ring 32 to the shaft 34, so that the shaft 34 is moved upwards in FIG. 2 until its upper face engages with the vortex channel construction 45 on the upper end wall bounding the discharge chamber. As can be seen in FIG. 2, in this position the connecting channel 35 is connected by means of the lateral openings 49 to the annular medium reservoir 43, but which remains sealed by the lips 41 to the adapter interior 25. However, the upper sealing lip 47 is bypassed by an annular groove 54 in the shaft, so that a discharge flow channel is formed via the overflow channels 48 and the vortex channel construction 45 to the discharge orifice (nozzle) 44.

The pressure of the shaft 34 on the plug/piston 26 produces the necessary application pressure, which delivers the liquid through the needle 37, the connecting channel 35 and the openings 49 into the medium reservoir 53, where it is mixed with the solid medium 51, which can be aided by the design of the medium reservoir and/or the openings 49, e.g. through their inclined position for the production of a vortex. The resulting mixture is then discharged from the discharge orifice, particularly in finely sprayed form. The sealing lips 47 together with the upper piston section 47*a* or the groove 54 form the discharge valve. The dispenser is intended with a single, but in this case two-stage actuating stroke to discharge the complete solid medium and liquid charge stored in it in separate and tightly sealed form.

Figures 3, 4:
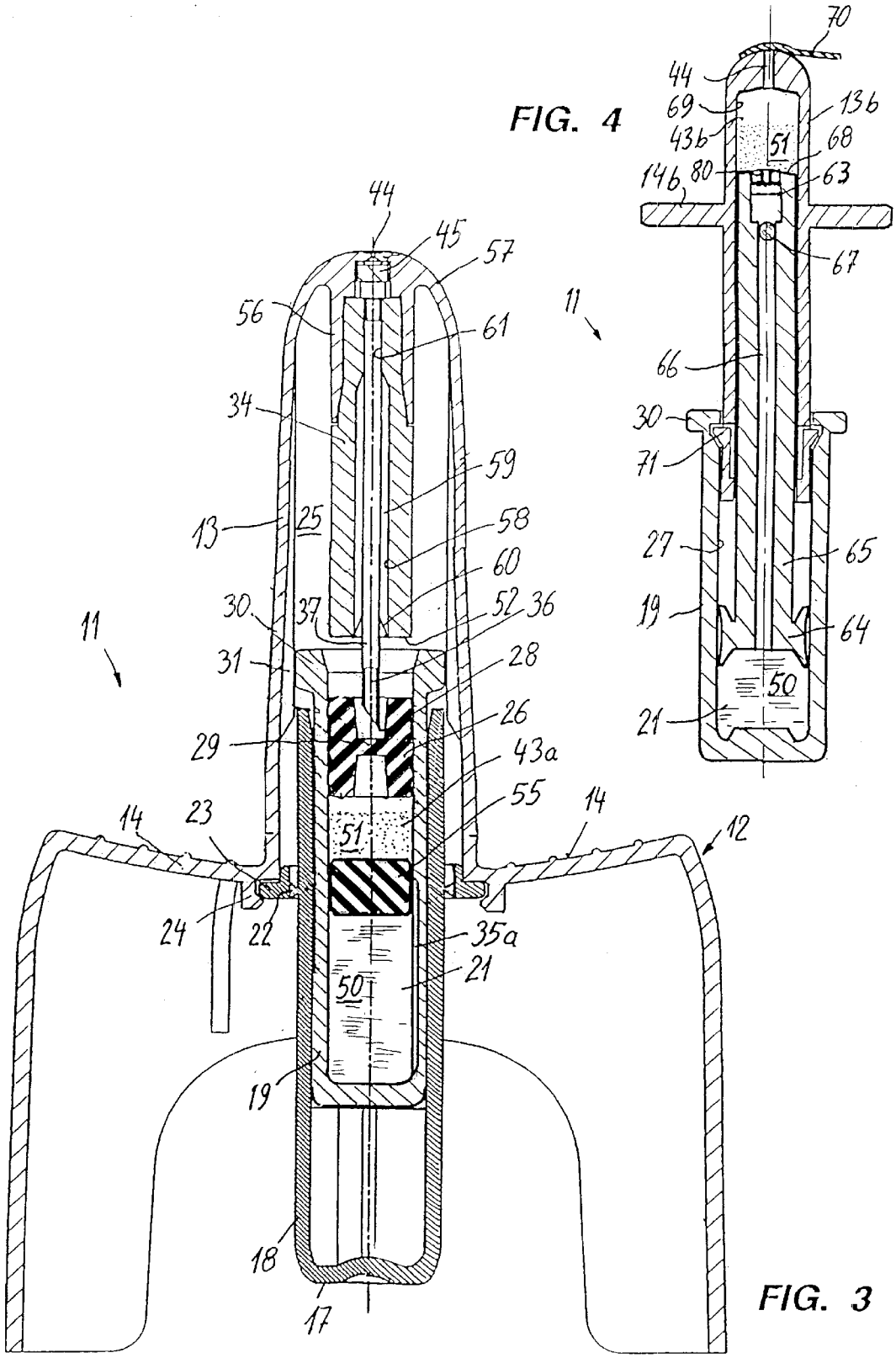
FIGS. 3 & 4 Longitudinal sections through other embodiments.

Apart from the differences described hereinafter, the construction of the dispenser according to FIG. 3 is the same as that shown in FIGS. 1 and 2. Reference is made to the description of the latter and the same reference numerals are used.

In the sleeve 18 is received an ampoule 19, which is longer than that according to FIG. 1. In axially succession it contains both the liquid chamber 21 and also the medium reservoir 43*a*. Thus, apart from the closing plunger 26 sealing the medium reservoir 43*a* here, the ampoule 19 contains an intermediate piston 55 separating the liquid chamber 21 from the medium reservoir 43*a* and which in the rest state shown in FIG. 3 seals the two chambers from one another. For the connection thereof a connecting channel 35*a* is formed in the wall of the ampoule 19 and its outlet into the medium reservoir 43*a* is sealed in the rest state of the intermediate piston 55.

The shaft 34 is sealingly inserted in a support section 56 of the adapter 13, which is constructed in one piece with the casing 12 (and therefore with the adapter 13). The hemispherical adapter end 57 is also constructed in one piece therewith in that also the nozzle-like discharge orifice 44 is provided. On its upper end face the shaft contains the vortex chamber construction 45 cooperating with the discharge nozzle. The shaft receives the ram 37, which is formed by a steel needle and extends almost entirely through the shaft 34 up to just before its upper face. The needle, which generally has an external diameter of less than 1 millimetre and a correspondingly small wall thickness, is very carefully sharpened for forming a sharp, burr-free tip 38 and without the adapter 39 shown in FIG. 1 is directly inserted in a bore 58 of the shaft. This bore has a much larger diameter than the needle 37, but guides the latter through e.g. four webs 59 projecting radially inwards from the bore inner wall and which commence with an insertion bevel 60 in the vicinity of the face 52 of the shaft 34. They ensure a precise centring and prevent buckling of the thin needle on insertion. They extend from the free end of the shaft up to a fitting bore 61, i.e. over most of the central area of the needle particularly important for preventing buckling.

At the upper end, i.e. that remote from the tip 28, the needle 37 is pressed into a fitting bore 61, which is so dimensioned that it permits a tight press fit of the needle therein. A shoulder 62 in said fitting bore forms an upper stop for the pressing in of the needle. The fitting bore embraces the upper end of the needle over a length greater than a multiple, e.g. five times the external diameter of the needle. The upper end of the fitting bore is connected to the discharge chamber 46.

The dispenser comprises very few parts. The shaft 34 with the needle fitted therein is inserted in the one-piece casing, in which is directly shaped the discharge orifice 44. The dispenser is completed by the sleeve 18/ampoule 19 unit with closing plug 26 and the intermediate piston 55, separating the liquid and the medium chamber.

The assembly of the dispenser in accordance with FIG. 3 is very simple. As a result of the novel construction of the shaft 34 the needle can be fitted without the annular adapter 39 in accordance with FIG. 1. The ribs 59 guide the needle on entering the bore 58, without opposing an excessive resistance in the longitudinal direction. Only when the needle has been guided over most of its length between the ribs does it enter the fitting bore 61, where it is pressed in in a sealing manner so as to be secured mechanically against extraction. As can be gathered from the drawing, only over a relatively small part of its length, usually less than one third, does the needle project from the shaft 34. Thus, the section most endangered by buckling, which is in the centre of the needle, when force is applied for its pressing into the fitting bore 61, is already guided in buckling preventing manner between the ribs.

It is particularly important that the sensitive needle tip 28 is not damaged during the pressing in process. Therefore working takes place with a tool, which grips the needle from the outside with a type of collet (in the area projecting from the shaft), but which additionally has a central pin engaging in the needle bore and consequently protecting the needle against crushing and damage to the tip.

The prefitted shaft can then be pressed into the connecting piece 56 with its upper, partly bevelled offset end.

The prefitted unit constituted by the sleeve and inserted ampoule 19 is fitted by means of the snap closure 24 to the casing 12. Beforehand the ampoule was filled with the liquid, followed by the fitting of the intermediate piston 55 and then the filling of the solid medium into the medium reservoir 43 above it. The closing plug 26 was then fitted.

As in FIGS. 1 and 2, on actuation the preset breaking point 22 is destroyed for obtaining an adequate initial pressure, which ensures that the user continues to the end the actuation with a certain force and speed. An interim interruption would e.g. lead to the dripping of the atomizer and would optionally impair the mixing of the substances or prevent a complete application.

Then the ram 37 (needle) perforates the web 29 in the piston 26 and then opens the discharge channel 36, mainly formed by t he interior of the hollow needle 371 with respect to the medium reservoir 43*a*. The shaft 34 presses the piston 26 downwards and compresses the solid medium 51 in the medium reservoir 43*a*, together with the air (or a corresponding inert gas) contained therein. Thus, the intermediate piston 55 is also pushed downwards and frees the connecting channel 35*a* in the ampoule wall. The latter could also be formed by a corresponding protuberance of said wall, which would then free an overflow channel on its two sides. The liquid 50 flows out of the liquid chamber 21 into the medium reservoir 43*a*, where it mixes with the medium 51 and is passed with the corresponding discharge pressure via the needle bore 36 to the discharge orifice 44. The sleeve 18/ampoule 19 unit, guided by the webs 31, slides upwards in the interior 25 of the nose adapter 13. Here again a complete discharge of the two media (plus the third medium "air") is possible. The air also forms a precompression, which aids the start of the atomizing phase. Optionally the arrangement could also be such that the medium was placed in the bottom-near area of the ampoule and the liquid above it. In this case the liquid would firstly flow downwards, mix there with the medium and then flow through the liquid chamber to the outlet. This could optionally bring about a particularly intimate mixing.

FIG. 4 shows a particularly simply constructed embodiment. In an ampoule 19, which can also be made from plastic and is in the form of a particularly deep bowl, is guided a liquid piston 64 sealing with piston lips and which is constructed in one piece at the lower end of a piston rod 65. A connecting chamber 63 receives the ball on being pressed out and a vortex channel/nozzle arrangement 80 similar to the nozzle 44 with vortex channel 45 ensures a jet distribution aiding the mixing of the media, optionally accompanied by angular momentum and atomization in the medium reservoir 43*b*.

It has a through central bore 66, in whose upper section is pressed a ball 67 as the sealing valve. Over the end of the piston rod 65 is engaged a sleeve-like adapter cap 13*b*, so that between the upper face 68 of the piston rod 65 and the interior 69 of the adapter cap 13*b* is formed the medium reservoir 43*c*. A discharge orifice 44 formed at the end of the adapter cap can be constructed as a spray or drop nozzle. It is sealed by a pull-off closure 70, e.g. a sealed-on aluminium foil.

The adapter cap 13*b* has lateral actuating shoulders 14*b* and engages with its lower part in the interior of the ampoule 19, i.e. it is guided on the cylinder wall 27. Resilient tabs 71 disengaged from the wall of the adapter cap 13*b* form together with a groove in the cylinder wall 27 on the one hand a snap closure securing the rest state and preventing a pulling of the adapter cap 13*c* from the ampoule and on the other ensure the necessary actuating force build-up prior to the start of actuation. As a result of the barb-like construction pulling off can be prevented and the actuating force build-up can be dimensioned in a predetermined manner.

This dispenser comprises a few relatively simple plastic parts, a foil portion and a small steel or plastic ball. It could also be replaced by a perforatable membrane or a membrane tearing through liquid pressure.

On production the liquid chamber 21 is filled with liquid 50, the piston/piston rod unit 64, 65 is inserted and then the adapter cap 13*b*, filled with the medium 51, is inserted.

For using the dispenser according to FIG. 4 firstly the pull-off closure 70 is pulled off, so that the discharge orifice 44 is open. Then, accompanied by the overcoming of the pressure point produced by the spring tabs 71, the piston 64 is pressed into the sleeve 19 (or vice versa). The resulting liquid pressure forces the ball 67 out of the overflow channel 66 into the chamber 63. The liquid sprays with an angular momentum in a sharp jet or atomizes in the medium reservoir 43*b*, mixes there with the medium 51 and passes as a mixture out of the discharge orifice 44.

Here again, prior to actuation, the individual chambers must be completely sealed with respect to one another and to the outside. The pull-off closure 70 could also be replaced by a valve opening in pressure-dependent manner, but is generally unnecessary in the case of a disposal dispenser. In this or the following construction according to FIGS. 5 to 7 it is also possible to use a discharge valve, which is deliberately opened by the user only following a mixing phase, e.g. a rotary slide valve, which is operated by rotating the upper section of the adapter cap 13, 13*b* with respect to the remaining casing. As a result of the rotation it would also be possible to free a stop, which prevented the piston rod during the first actuating step (mixing) from immediately discharging the mixture. The time required for operating the rotary valve could e.g. ensure the dissolving of the powder in the liquid.

In connection with the embodiments according to FIGS. 5 to 7 reference is again made to the detailed description of FIGS. 1 to 3 and only differences are described hereinafter.

The main difference is the unit containing the media and comprising the sleeve 18 and the ampoule 19. The sleeve 18, which is fitted to the casing 12 by means of the preset breaking ring 32, contains the liquid chamber 21 in its lower area facing its bottom 17, where a plastic ram 37*c* is formed, which projects centrally upwards in the sleeve and has a cruciform cross-section.

In piston-like sealing manner an inner sleeve 19*c* is inserted in the sleeve and has on its bottom a perforatable membrane 29*c*. This sleeve seals in the upward direction the liquid chamber. It is inserted by means of a preset breaking ring 32 into the interior 25 of the nose adapter 13. The preset breaking ring operates with material bridges 33, as described hereinbefore. The inner sleeve 19*c* forms a cylinder for a reservoir/mixing chamber 43*c*, which is upwardly sealed by an inverted, sleeve-shaped closing plug 26*c* serving as a piston.

Figure 5:
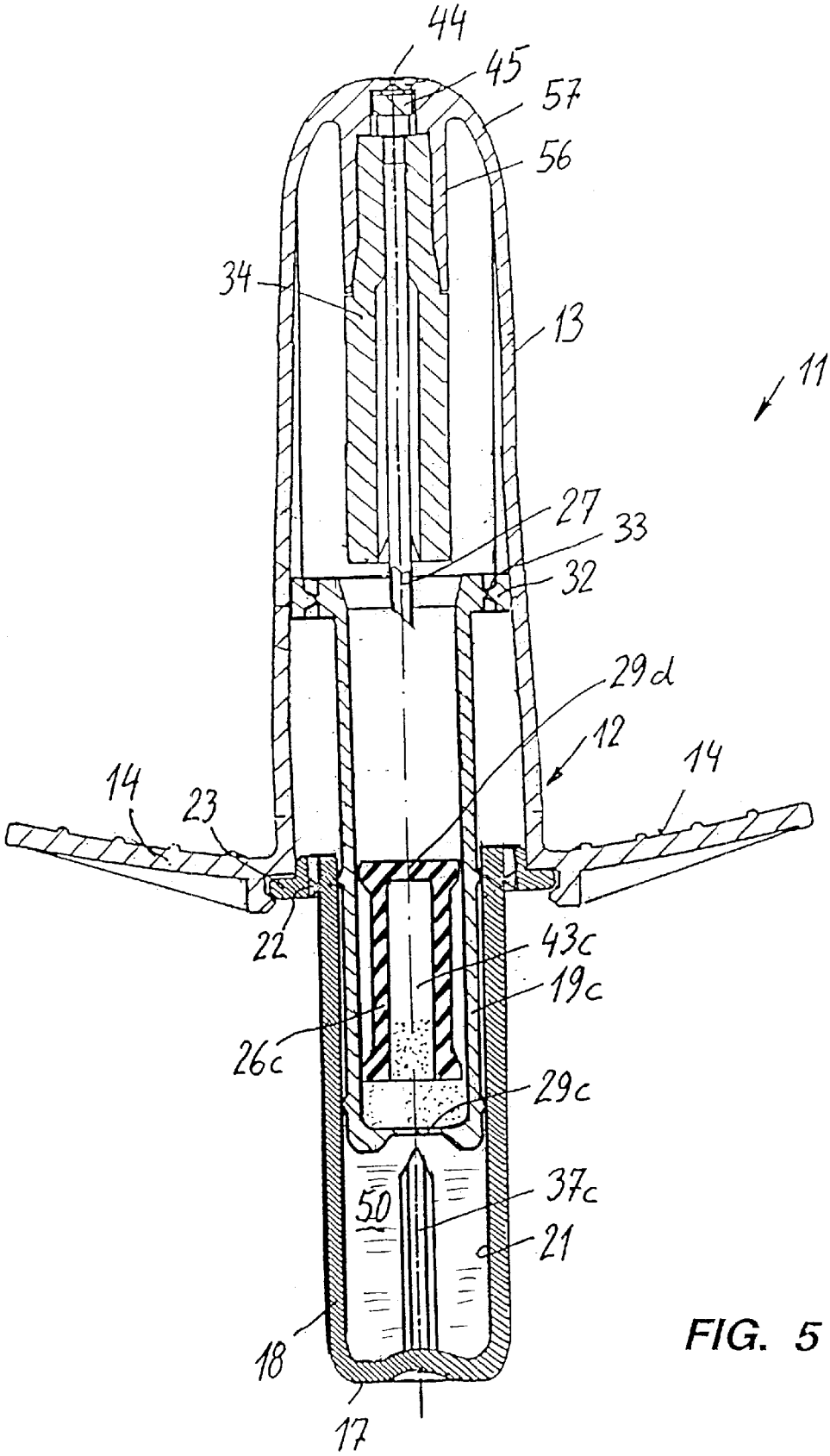
FIGS. 5 to 7 Three operating positions of a further, preferred embodiment, in each case in longitudinal section.
Figure 6:
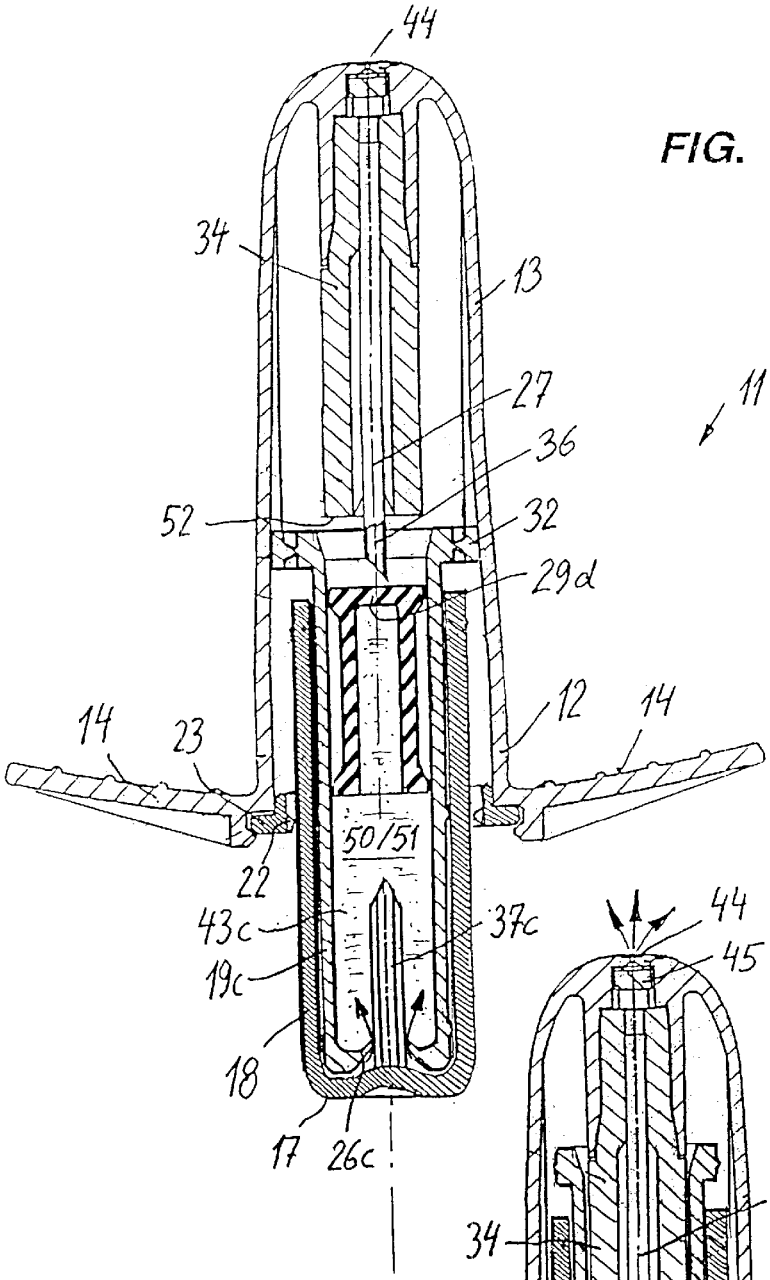
Figure 7:
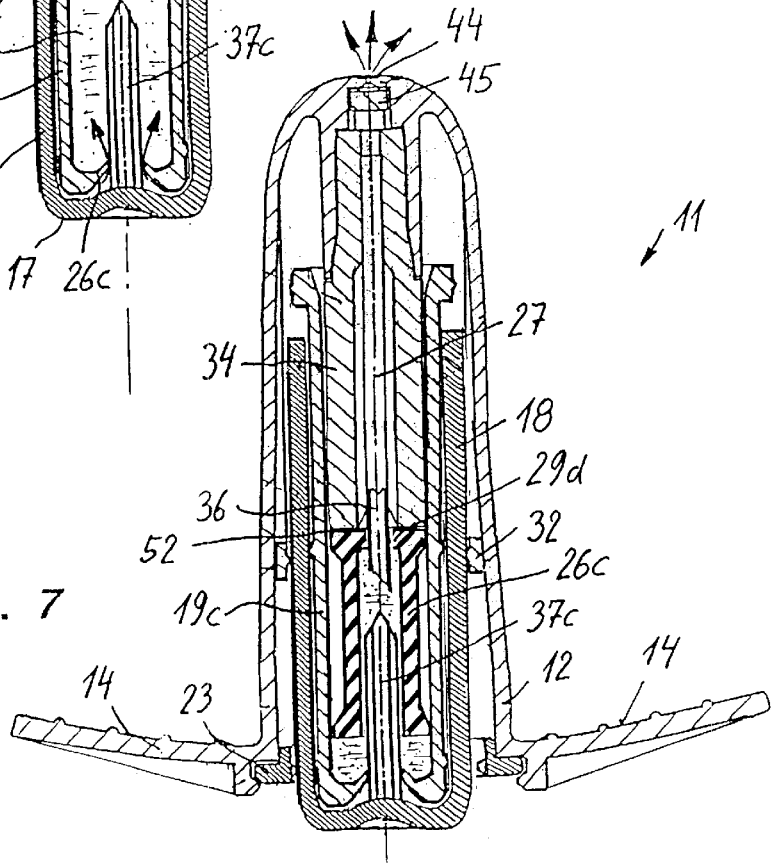

During the manufacture of the dispenser 11 according to FIGS. 5 to 7 the liquid 50 is introduced into the liquid chamber 21 and the solid medium 50 into the medium reservoir 43*c*, which is sealed by the closing plug 26*c*. The inner sleeve 19*c* is inserted in the manner of a piston into the sleeve 18, which consequently forms the cylinder of a second thrust piston pump on said dispenser and upwardly seals the liquid chamber 21.

On actuation firstly the preset breaking closure 32 is broken through. The ram 37*c* then penetrates through the membrane 29*d* and by means of the channels formed in the cruciform cross-section forms the connection between the liquid chamber 21 and the medium reservoir 43*d*. The piston-like, lower part of the inner sleeve 19*c* reducing the size of the liquid chamber 21 feeds the liquid 50 into the medium storage space 43*c*, which thereby increases in size, in that under the thus formed medium pressure it forces upwards the plug 26*c*.

FIG. 6 shows the end of this mixing phase in which the liquid and solid medium are mixed. It is ended in that, as shown in FIG. 6, the bottom of the inner sleeve 19*c* engages on the bottom 17 of the sleeve 18. There is then only a common mixing chamber 43*c*. The air previously present in the medium chamber 43*c* can compress to a greater or lesser extent as a function of the resistance of the plug 26*c* and consequently maintain a basic pressure in the mixing chamber.

The preset breaking closure 32 can be set in such a way that the user, on reaching the position shown in FIG. 6, must apply a further, increased pressure, which ensures that there is an adequate time in the mixing chamber 43*c* for mixing and optionally dissolving the constituents.

As shown in FIG. 7, the preset breaking closure 32 then breaks, the needle 37 penetrates through the bottom 29*d* of the closing plug 26*c*, which is then contacted by the face 52 of the shaft 34 and is pressed in the manner of a piston into the inner sleeve 19*c* forming a pump cylinder. The mixture 50/51 is then transported from the mixing chamber 43*d* via the discharge channel formed by the needle bore 36 to the discharge orifice 44 and is atomized there under the discharge pressure or is discharged in some other way. As described relative to FIG. 3, the application phase could be time-limited in addition to or in place of the preset breaking ring 32 by a stop released by rotation. It is also possible to use in place of the perforating needle a rotary slide valve which is opened by this rotation.

Thus, in this embodiment the mixing phase can be spatially and also time separated from the application phase, although everything substantially directly successively takes place, i.e. there is no risk of the solid medium being damaged in the mixing phase. It is also possible to distribute these two phases over two different actuating strokes instead of carrying them out in two axially succeeding stroke sections, as in FIGS. 5 to 7. By a corresponding subdivision or sequence of strokes, it is also possible to discharge a charge premixed in a first stroke in two succeeding partial discharge strokes, in order e.g. to successively apply a medicament to the two nostrils of a patient. A multiple use dispenser or rechargeable dispenser in accordance with the above-described principle is also possible.

What is claimed is:

1. A method for spray discharging a mixture of at least two different media by manual discharge actuation, comprising the steps of:

using a liquid as a carrier medium for a particulate solid medium;

storing the carrier medium and the solid medium prior to a mixing phase, the carrier and solid media stored separately and sealed from one another and from the atmosphere;

mixing the carrier medium and the solid medium by applying a mixing force to form the mixture in a mixing phase prior to a discharge phase;

applying an actuating force greater than the mixing force for overcoming an intermediate stop demarcating the mixing phase and the discharge phase; and discharging the mixture in atomized form in the discharge phase by applying a discharge force, wherein the discharge force is applied at a level which is predetermined to be sufficient to overcome the intermediate stop and atomize the mixture upon discharge.

2. The method according to claim 1, wherein the solid medium is a particulate, pharmaceutical product intended for absorption by body mucosa.

3. The method according to claim 1, wherein the solid medium is a particulate, pharmaceutical product in the form of a freeze-dried powder.

4. The method according to claim 1, wherein the mixing phase takes place directly prior to the discharge phase.

5. The method according to claim 1, wherein during the mixing phase a gas stored together with the solid medium is compressed with the introduction of the liquid.

6. The method according to claim 1, further comprising the step of an additional actuation for overcoming the intermediate stop between the mixing phase and the discharge phase.

7. A method for spray discharging a mixture of at least two different media by manual discharge actuation, comprising the steps of:

using a liquid as a carrier medium for a particulate solid medium; storing the carrier medium and the liquid medium prior to a mixing phase, the carrier and solid media stored separately and sealed from one another and from the atmosphere; mixing the carrier medium and the solid medium by applying a mixing force to form the mixture in a mixing phase prior to a discharge phase;

applying an actuating force greater than the mixing force for overcoming an intermediate stop demarcating the mixing phase and the discharge phase; discharging the mixture in atomized form in the discharge phase by applying a discharge force; and performing an additional actuation for overcoming the intermediate stop between the mixing phase and the discharge phase.

8. A dispenser for spray discharging a mixture of at least two different media by manual discharge actuation along an actuation path, wherein said actuation path includes a mixing path and a discharge path, said dispenser comprising:

a liquid chamber for storing a liquid;

a pump for producing a mixing pressure on application of a mixing force to the pump and a discharge pressure for feeding the liquid to a spray nozzle on application of a discharge force to the pump;

a solid medium chamber provided for a particulate solid medium separate from the liquid chamber, wherein prior to the actuation of the dispenser, the liquid chamber and solid medium chamber are sealed from the outside and from one another and as a result of the actuation are connected to one another by a connecting channel and are connected to the spray nozzle by a discharge channel;

the solid medium chamber forming a mixing chamber, in which the liquid and the solid media are mixed; and an intermediate stop provided in the actuation path to be overcome by application of a dispensing force to the pump that is greater than the mixing force for overcoming the intermediate stop and for initiating discharge along the discharge path.

9. The dispenser according to claim 8, wherein the pump is a thrust piston pump having a cylinder formed by the liquid chamber, and wherein the piston of the thrust piston pump is irreversibly actuable, thus forming a disposable dispenser.

10. The dispenser according to claim 8, further comprising a shutoff member situated between the liquid chamber and solid medium chamber, the shutoff member opening as a result of actuation of the dispenser.

11. The dispenser according to claims 8, further comprising pressure point means whereby actuation of the dispenser is dependent on reaching a predetermined actuating pressure.

12. The dispenser according to claim 8, wherein the pressure point means contain preset breaking points.

13. The dispenser according to claim 8, wherein the pressure point means are provided both for the actuation of the pump and for opening of the solid medium chamber, as well as for delivering the liquid into the solid medium chamber.

14. The dispenser according to claim 8, wherein the liquid chamber and solid medium chamber are arranged in axially succeeding manner in a generally cylindrical container and are sealed from one another and from the outside by at least one piston, the piston acting to open a connecting channel between the liquid chamber and the solid medium chamber.

15. The dispenser according to claim 8, wherein for connecting the liquid chamber and the solid medium Chamber and for mixing the liquid medium with the solid medium there is at least one first actuating stroke, and for discharging the mixture there is a second actuating movement, wherein the first actuating stroke and the second actuating movement are demarcated from one another by the intermediate stop, and wherein the intermediate stop is a separate manually operable stop.

16. The dispenser according to claim 8, wherein the liquid chamber and the solid medium chamber are arranged in axially succeeding manner and a separating element is displaceably located between them.

17. The dispenser according to claim 8, wherein a guide device is associated with the connecting channel between the liquid chamber and the solid medium chamber for accelerating, agitating and distributing liquid entering the solid medium chamber.

18. The dispenser according to claim 8, wherein for connecting the liquid chamber and the solid medium chamber and for mixing the liquid medium with the solid medium there is at least one first actuating stroke and for discharging the mixture there is a second actuating movement, wherein the first actuating stroke and the second actuating movement are demarcated from one another by the intermediate stop, and wherein the intermediate stop is a pressure point means.

19. The dispenser according to claim 8, further comprising at least one perforating element for connecting the liquid chamber and the solid medium chamber to one another and to the discharge orifice, wherein the perforating element includes a needle-like ram having at least one liquid channel and which perforates a piston of the pump constructed as a closing plug, and wherein the perforating element is received in a shaft and acts on the piston for displacement thereof.

20. The dispenser according to claim 8, wherein the liquid chamber and the solid medium chamber are arranged in axially succeeding manner and at least one of the chambers can be enlarged for at least a partial volume adaptation to the volume of the mixture.

21. A dispenser having a discharge orifice and solid medium chamber forming a thrust piston pump cylinder, closed by a piston constructed as a closing plug, comprising at least one perforating element including a hollow needle having at least one liquid channel and which is provided to perforate the piston and which is received in a shaft, wherein:

the needle acts on the piston for displacement thereof;

the needle comprises a thin, hollow steel needle inserted in adapter-less manner in a shaft of the dispenser;

the needle is sealingly inserted at an end remote from the needle tip in a fitting bore, wherein a diameter of the bore is greater than an external diameter of the needle;

the needle engages with said end on a shoulder in the fitting bore, the shoulder acting as a stop to limit pressing in of the needle into the bore; and the needle is guided in its central area between ribs in the interior of a larger bore until it passes out of the shaft over a length which is a multiple times the external diameter of the needle, wherein the larger bore has at its start an insertion bevel for the needle.

22. The dispenser according to claim 21, wherein the hollow needle has an interior forming a receptacle for a holding and filling pin of a gripping device, which externally grips the needle from the outside in collet-like manner for the pressing of the needle into the shaft.

23. The dispensers according to claim 21, wherein the diameter of the fitting bore is at least two times greater than the diameter of the needle.

* * * * *